United States Patent [19]

Bobry

[11] Patent Number: 4,975,649

[45] Date of Patent: Dec. 4, 1990

[54] METHOD AND APPARATUS FOR SENSING LOSS OF REGULATION IN A FERRORESONANT TRANSFORMER

[75] Inventor: Howard H. Bobry, Edmonds, Wash.

[73] Assignee: Albar, Inc., Lynnwood, Wash.

[21] Appl. No.: 451,816

[22] Filed: Dec. 18, 1989

[51] Int. Cl.[5] ..... G05F 3/06

[52] U.S. Cl. ..... 324/547; 323/309; 307/351

[58] Field of Search ..... 324/547, 546; 323/308, 323/309, 248; 307/351

[56] References Cited

U.S. PATENT DOCUMENTS

| | | | |
|---|---|---|---|
| 2,444,794 | 7/1948 | Uttal et al. | 323/308 |
| 3,022,458 | 2/1962 | Sola | 323/308 |
| 3,546,571 | 12/1970 | Fletcher et al. | 323/309 |
| 3,678,377 | 7/1972 | Chiffert | 324/547 |
| 3,742,251 | 6/1973 | Thompson et al. | 307/351 |
| 3,938,033 | 2/1976 | Borkovitz | 323/308 |
| 4,122,382 | 10/1978 | Bernstein | 307/351 |
| 4,130,790 | 12/1978 | Heisey | 323/309 |
| 4,466,041 | 8/1984 | Witulski et al. | 323/248 |

*Primary Examiner*—Reinhard J. Eisenzopf
*Assistant Examiner*—Maura K. Regan
*Attorney, Agent, or Firm*—Pearne, Gordon, McCoy & Granger

[57] ABSTRACT

A method and apparatus for detecting the loss of regulation in ferroresonant transformer is disclosed. The flux in the magnetic shunts is sensed by a winding. The resulting signal is differentiated. If the differentiated signal contains pulses, regulation is present, if no pulses are found the transformer is not in regulation.

6 Claims, 2 Drawing Sheets

METHOD AND APPARATUS FOR SENSING LOSS OF REGULATION IN A FERRORESONANT TRANSFORMER

BACKGROUND OF THE INVENTION

The present invention relates to ferroresonant transformers and, in particular, a method and apparatus for sensing the loss of regulation in a ferroresonant transformer.

A ferroresonant transformer may be considered to operate on the principle of flux gain. A primary winding provides excitation to a portion of a core which does not operate in saturation. This core section is coupled to another section of the core which links to the secondary winding. The primary and secondary windings are separated by magnetic shunts, which effectively function as a series inductance placed between the primary and secondary circuits. The core section linked to the secondary winding operates in saturation when the transformer is regulating.

The secondary circuit drives a capacitor, which, together with the inductance of the secondary circuit, forms a parallel resonant circuit, the gain of which is intended to be sufficient to drive the section of the core linked to the secondary into saturation. The secondary voltage is constant, or regulated, as long as the flux through the secondary section of the core is constant, which occurs when it is saturated.

Two factors act to reduce the flux in the secondary section, and thus pull the transformer out of regulation. First, the flux in the primary section of the core is dependent upon the magnitude of the input voltage. As the input voltage is decreased, a point will be reached at which there is insufficient gain to produce saturation flux levels in the secondary section. At this point, the transformer's output voltage begins to decrease. Additionally, as load is increased, the Q of the tuned circuit is decreased, hence the gain decreases. At some point, the gain is reduced to the point where the secondary drops out of saturation and regulation.

Because it depends on load as well as the input voltage, regulation can vary significantly depending on the load. For example, a ferroresonant transformer may be designed for operation from a nominal 120 volt source, with sufficient flux gain such that the transformer will maintain regulation at full load as the input voltage is decreased to 100 volts. However, at half load, regulation may be maintained down to an input voltage of 60 volts.

There are numerous applications for ferroresonant transformers in which it would be beneficial to be able to detect when the flux gain was becoming marginal. In other words, when the transformer was about to drop out of regulation.

For example, ferroresonant transformers are used in uninterruptible power supplies where the primary is driven by the a.c. line until a power failure or low line voltage condition occurs, at which time an inverter is used to drive the primary from a battery power source. Based on the existing art, the inverter must be started when the input voltage drops to the level at which the ferroresonant transformer would lose regulation if it were fully loaded, when in reality, it is typically not fully loaded. By detecting the actual point of loss of the necessary flux to maintain regulation, it would be possible, in many cases, to continue to operate on the a.c. line until that point was actually reached.

Sensing the loss of sufficient flux gain for regulation also would provide advance warning not available by merely monitoring the output voltage, because a ferroresonant transformer uses its stored energy to proved an output for nearly a full cycle after an input voltage failure. This advanced warning can be very valuable in some applications. For example, in computer power supplies, a few milliseconds warning of a shutdown can make the difference between an orderly shutdown and a system crash.

SUMMARY OF THE INVENTION

A ferroresonant transformer has a primary flux, a secondary flux and a shunt flux. The shunt flux is indicative of the regulation status of the transformer.

This status may be determined by producing a signal representative of the shunt flux and detecting if the signal is not substantially sinusoidal. If it is not substantially sinusoidal the transformer is in regulation. If it is substantially sinusoidal, the transformer is not in regulation.

The shunt flux may be sensed by placing a winding around at least a portion of the shunt flux.

Alternatively, the shunt flux may be sensed by subtracting a signal representative of the secondary flux from one representative of the primary flux. This may be accomplished by connecting primary and secondary sense windings in serial differential relationship.

To identify the signal representative of the shunt flux as sinusoidal, or not, it is differentiated. If pulses are then detected in the derivative, the shunt flux is not sinusoidal. If no pulses are detected, the shunt flux is sinusoidal.

DESCRIPTION OF THE PREFERRED EMBODIMENTS

Figure 1:
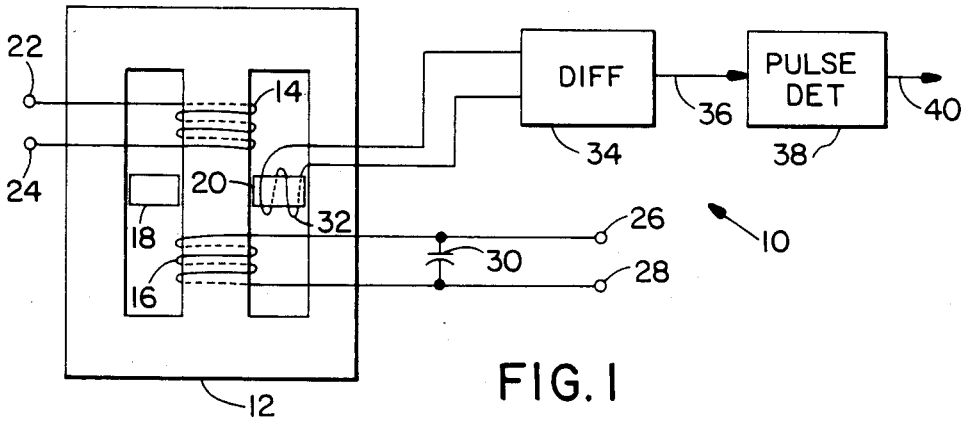
FIG. 1 is a schematic diagram of a ferroresonant transformer according to the invention.

FIG. 1 is a schematic diagram of a ferroresonant transformer 10 according to the invention. A magnetic core 12 is provided with a primary winding 14 and a secondary winding 16. Two magnetic shunts 18, 20 are provided between the windings 14, 16.

The primary winding 14 has two input terminals 22, 24. The secondary winding 16 has two output terminals 26, 28. A capacitor 30 is connected between the output terminals 26, 28.

A winding 32 is provided around the shunt 20 (or alternatively around the other shunt 18). The shunt winding 32 is connected to a differentiator 34. The output 36 of the differentiator 34 is applied to a pulse detector 38. The pulse detector 38 has an output signal 40.

In operation, the terminals 22, 24 are connected to a.c. mains. The a.c. current flowing through the primary winding 14 establishes a flux in the core 12. Part of this flux couples with the secondary winding 16 and the rest returns by the shunts 18, 20.

The flux coupled to the secondary winding 16 induces a voltage across the output terminals 26, 28 and the capacitor 30. The capacitor 30 is of a value such that it and the inductance of the circuit form a parallel resonant circuit tuned to the frequency of the a.c. mains. Energy stored in the resonant circuit results in additional flux within the secondary winding 16, which may be either coupled with the primary winding or returned by the shunts 18, 20.

The resultant fluxes in the transformer 10 may be described by three fluxes: the primary flux, that is, the total flux within the primary winding 14; the secondary flux, that is, the total flux within the secondary winding 16; and the shunt flux, that is, the total flux within the shunts 18, 20.

When the transformer 10 is in regulation, there is sufficient energy in the resonant circuit to maintain the secondary portion of the core 12 in saturation. In this condition, the secondary flux is constant and thus the voltage at the output terminals 26, 28 is constant.

When the transformer 10 is not in regulation, the parallel resonant circuit is not able to store sufficient energy to maintain the secondary portion of the core 12 in saturation. This may be because the input voltage of the a.c. mains is insufficient, a load attached to the output terminals 26, 28 is drawing too much energy, or, typically, a combination of both.

The shunt flux (or a fraction thereof) can be used to provide the indication of regulation status of a ferroresonant transformer.

The shunt winding 32 provides a voltage corresponding to the flux within the shunt 20. It would of course be possible to measure the flux in other ways, for example, with a Hall-effect sensor.

Figure 2:
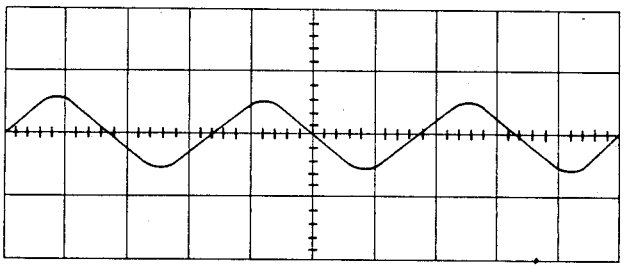
FIG. 2 is an oscillograph of the shunt flux/voltage of a ferroresonant transformer not in regulation.
Figure 3:
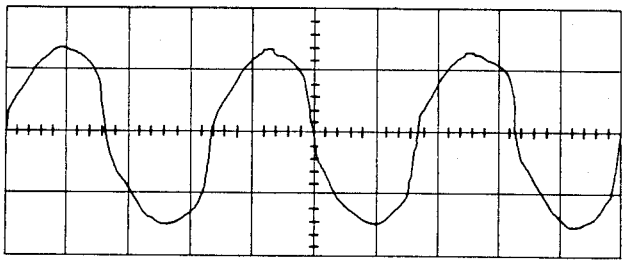
FIG. 3 is an oscillograph of the shunt flux/voltage of a ferroresonant transformer in regulation.

FIG. 2 shows an oscillograph of an exemplary voltage induced in the shunt 20 when the transformer 10 is not in regulation. FIG. 3 shows an oscillograph of an exemplary voltage induced in the shunt 20 when the transformer 10 is in regulation.

It is not the amplitude, but the shape, of the waveforms of FIGS. 2 and 3 that contain the information on the regulation status of the transformer 10. The waveform of FIG. 2 is basically sinusoidal, while that of FIG. 3 is not. When the shunt flux is basically sinusoidal, the transformer 10 is not in regulation, while when the shunt flux is non-sinusoidal, the transformer is in regulation.

To detect whether the shunt flux is sinusoidal or not, the differentiator 34 may be advantageously employed to differentiate the voltage from the shunt winding 32.

Figure 4:
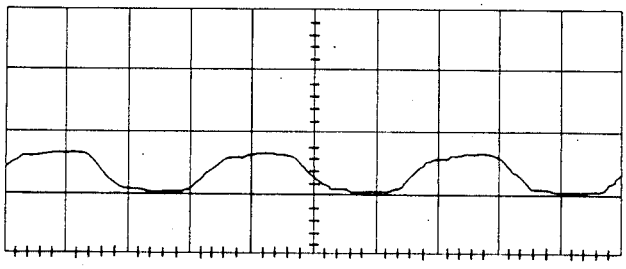
FIG. 4 is an oscillograph of the derivative of the shunt flux/voltage of a ferroresonant transformer not in regulation.
Figure 5:
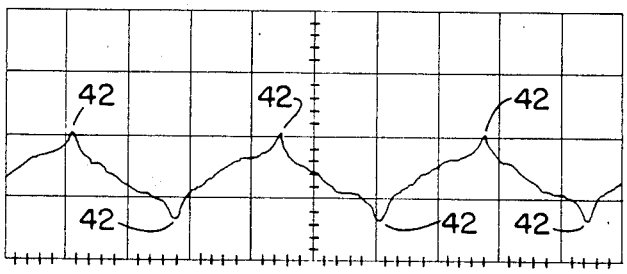
FIG. 5 is an oscillograph of the derivative of the shunt flux/voltage of a ferroresonant transformer in regulation.

FIG. 4 shows an oscillograph of an exemplary output 36 of the differentiator 34 when the transformer 10 is not in regulation. FIG. 5 shows an exemplary output 36 when the transformer 10 is in regulation.

As is well known, the derivative of a sinusoid is another sinusoid, while that of a non-sinusoid is not.

The waveform of FIG. 4 is basically sinusoidal, while the waveform of FIG. 5 displays spikes or pulses 42 that are characteristic of the transformer 10 being in regulation.

The pulse detector 38 detects the presence or absence of the pulses 42. If the pulses are detected, the shunt flux is non-sinusoidal and thus the transformer 10 is in regulation. As a result, the output signal 40 is a signal indicative of regulation, for example, a voltage representative of a digital one.

If no pulses are detected, the shunt flux is sinusoidal and thus the transformer 10 is not in regulation. As a result, the output signal 40 is a signal indicative of loss of regulation, for example, a voltage representative of a digital zero.

Figure 6:
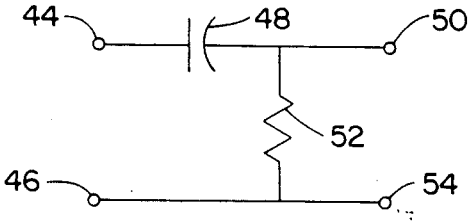
FIG. 6 is a schematic diagram of a differentiator circuit.

FIG. 6 is a schematic diagram of a possible implementation of the differentiator 34. The winding 32 is connected across the input terminals 44, 46. A capacitor 48 is connected between the input terminal 44 and the output terminal 50. A resistor 52 is connected between the output terminal 50 and the other output terminal 54 (as well as the input terminal 54).

The implementation of the pulse detector 38 would be within the ability of one skilled in the electronics art.

Figure 7:
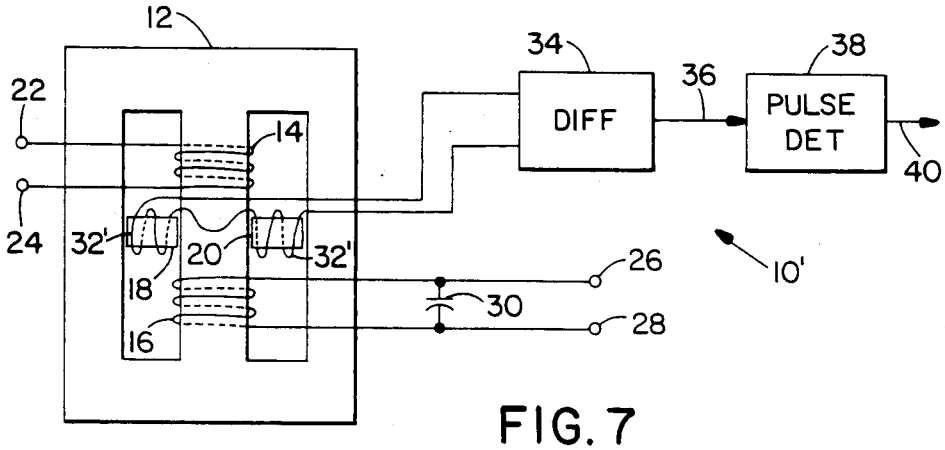
FIG. 7 is a schematic diagram of an additional embodiment of a ferroresonant transformer according to the invention.

The transformer 10 of FIG. 1 uses a winding 32 only around one of the shunts 18, 20 (in this case the shunt 20). Thus, only a portion of the shunt flux is sensed (i.e. the portion in the shunt 20). FIG. 7 is a schematic diagram of a ferroresonant transformer 10′ according to the invention in which the entire shunt flux is sensed. The winding 32′ is wound about both shunts 18, 20. The winding 32′ is wound so that the voltage induced by each shunt is additive to the other.

Figure 8:
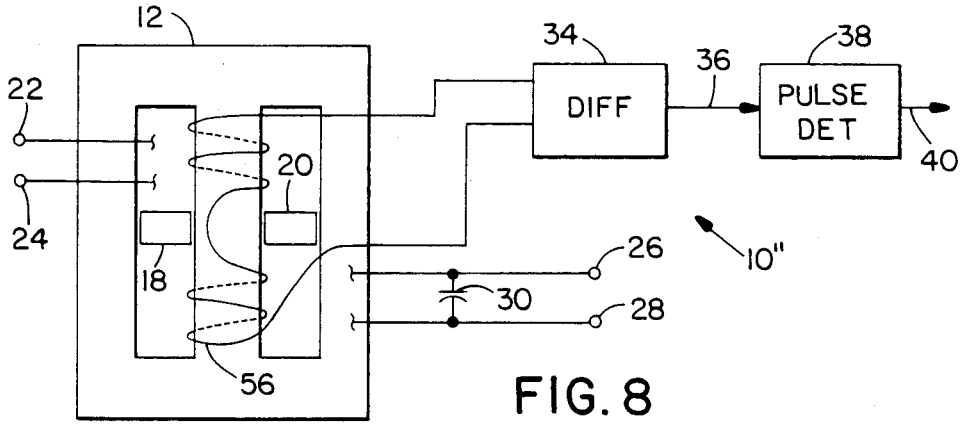
FIG. 8 is a schematic diagram of another additional embodiment of a ferroresonant transformer according to the invention with the secondary and primary windings cut away.

FIG. 8 is a schematic diagram of a ferroresonant transformer 10″ according to the invention in which the shunt flux is sensed by an alternate method. The primary and secondary windings which would appear as in FIGS. 1 and 7 have been removed to better show the winding 56.

Because the difference between the primary flux and the secondary flux is the shunt flux, the shunt flux may be sensed indirectly by measuring the primary and secondary fluxes. The winding 56 is wound around both the primary and secondary portions of the core 12 such that a voltage corresponding to the difference between the primary flux and the secondary flux is produced (i.e. inverted series connection). This voltage is equivalent to the shunt flux and is applied to the differentiator 34.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method for sensing loss of regulation in a ferroresonant transformer having a primary winding adapted to generate a primary flux, a secondary winding magnetically coupled to said primary winding and adapted to generate a secondary flux and a shunt providing a shunt path for a portion of said primary and secondary fluxes, said portion of said primary and secondary fluxes constituting a shunt flux, the method comprising:

producing a signal representative of said shunt flux;

differentiating said signal to provide a derivative; and detecting spikes in said derivative, wherein said transformer is in regulation if spikes are detected or said transformer is not in regulation if no spikes are detected.

2. A method according to claim 1, wherein, said signal is produced by a winding around at least a portion of said shunt flux.

3. A method according to claim 1, wherein, said signal is produced by a winding around at least a portion of said primary flux and another winding around at least a portion of said secondary flux, said windings being connected in inverted series relationship.

4. An apparatus for sensing loss of regulation in a ferroresonant transformer having a primary winding adapted to generate a primary flux, a secondary winding magnetically coupled to said primary winding and adapted to generate a secondary flux and a shunt providing a shunt path for a portion of said primary and secondary fluxes, said portion of said primary and secondary fluxes constituting a shunt flux, the apparatus comprising:

shunt flux sensing means in sensing proximity of at least one of said fluxes;

a differentiator having an input and an output, said input being connected to said sensing means; and a pulse detector connected to said differentiator output, wherein said transformer is in regulation if spikes are detected by said pulse detector or said transformer is not in regulation if no spikes are detected.

5. An apparatus method according to claim 4, wherein, said flux sensing means comprises a winding around at least a portion of said shunt flux.

6. An apparatus according to claim 4, wherein, said flux sensing means comprises a winding around at least a portion of said primary flux and another winding around at least a portion of said secondary flux, said windings being connected in inverted series relationship.

* * * * *